US005402033A

United States Patent [19]

van der Leeuw et al.

[11] Patent Number: 5,402,033

[45] Date of Patent: Mar. 28, 1995

[54] HIGH PRESSURE DISCHARGE LAMP HAVING CLAMPED-ON CONTAINMENT SLEEVE

[75] Inventors: Bart van der Leeuw, Hammondsport; Thomas W. Morris, Bath; Joseph E. Canale, Painted Post, all of N.Y.; Henrikus J. H. Pragt, Eindhoven, Netherlands

[73] Assignee: Philips Electronics North America Corporation, New York, N.Y.

[21] Appl. No.: 126,835

[22] Filed: Sep. 24, 1993

Related U.S. Application Data

[63] Continuation-in-part of Ser. No. 994,572, Dec. 27, 1992.

[30] Foreign Application Priority Data

Dec. 23, 1991 [EP] European Pat. Off. ..... 91203379

[51] Int. Cl.[6] ..... H01J 61/50; H01J 61/35

[52] U.S. Cl. ..... 313/25; 313/573; 313/634; 313/324; 313/642

[58] Field of Search ..... 313/25, 26, 572, 571, 313/573, 634, 639, 643, 312, 313, 317, 324, 642, 242, 292; 362/186, 297, 350; 220/2.1 R

[56] References Cited

U.S. PATENT DOCUMENTS

| | | | |
|---|---|---|---|
| 2,845,557 | 8/1956 | Gottschalk | 313/25 |
| 4,709,184 | 11/1987 | Keeffe et al. | 313/638 |
| 4,721,876 | 1/1988 | White et al. | 313/25 |
| 4,888,517 | 12/1989 | Keeffe et al. | 313/25 |
| 4,950,938 | 8/1990 | Ramaiuh | 313/25 |
| 4,963,790 | 10/1990 | White et al. | 313/113 |
| 5,039,912 | 8/1991 | Van Vliet et al. | 313/25 |
| 5,043,623 | 8/1991 | Scholz et al. | 313/25 |
| 5,136,204 | 8/1992 | Muzeroll etal. | 313/25 |

FOREIGN PATENT DOCUMENTS

| | | |
|---|---|---|
| 0361530 | 4/1990 | European Pat. Off. . |
| 0475381 | 3/1992 | European Pat. Off. . |
| 2201860 | 8/1990 | Japan . |

*Primary Examiner*—Donald J. Yusko
*Assistant Examiner*—Ashok Patel
*Attorney, Agent, or Firm*—Brian J. Wieghaus

[57] ABSTRACT

The electric discharge lamp has a discharge vessel, which is mounted in an outer bulb. A containment shield surrounds the discharge vessel and includes a glass sleeve and a helically coiled wire about the sleeve. Electrically isolated clamping leads extending from the seals axially secure the glass sleeve about the discharge vessel so that it is electrically isolated. The wire is fixed around the sleeve in an electrically floating manner, e.g. by clamping fit and/or by bent end portions secured over the ends of the glass sleeve. The construction of the lamp is simple and effective to protect the outer bulb from being damaged by an explosion of the lamp vessel and to prevent accelerated sodium depletion from the discharge vessel.

18 Claims, 1 Drawing Sheet

HIGH PRESSURE DISCHARGE LAMP HAVING CLAMPED-ON CONTAINMENT SLEEVE

CROSS-REFERENCE TO RELATED APPLICATIONS

This is a continuation-in-part of U.S. application Ser. No. 994,572, filed Dec. 27, 1992 of Henrikus J. Pragt entitled "Electric Lamp" which discloses and claims a discharge lamp having a containment sleeve with a coiled spring wire. This application further relates to U.S. application Ser. No. 08/126,820, of Bart van der Leeuw et al, filed concurrently herewith, entitled "High Pressure Discharge Lamp Having a Pinched-on Containment Sleeve" which discloses and claims a high pressure discharge lamp having a containment sleeve against the side faces of the discharge vessel press seals. The application also relates to U.S. application Ser. No. 08/126,834, filed concurrently herewith, of Bart van der Leeuw et al, entitled "High Pressure Discharge Lamp Having Filament Electrodes."

BACKGROUND OF THE INVENTION

The invention relates to an electric discharge lamp having an outer lamp envelope, a discharge vessel arranged within the outer envelope, the discharge vessel including a pair of discharge electrodes between which a discharge is maintained during lamp operation, opposing seals sealing the discharge vessel in a gas-tight manner, and a conductive feed-through extending from each discharge electrode through a respective seal to the exterior;

frame means for supporting the discharge vessel within the outer envelope and for electrically connecting the discharge vessel to a source of electric potential outside of the outer envelope; and a containment shield comprised of a light-transmissive sleeve disposed about the discharge vessel and having opposing ends each adjacent a respective seal of the discharge vessel.

Such a lamp is known from U.S. Pat. No. 5,136,204. The purpose of the containment sleeve is to keep the outer bulb intact if the discharge vessel should explode, which may occur when the lamp reaches the end of its life. The presence of the sleeve, however, complicates lamp construction because it must be supported about the discharge vessel. In the commercially available lamp according to this patent, the sleeve is quartz glass and has a wall thickness of 2 mm. Metal clips are secured on the press seals and include portions which hold the ends of the sleeve. The sleeve and discharge vessel are supported by welding the clips to an elongate metal support rod which is fixed around the lamp stem by a metal strap. The support rod, and consequently the metal clips and the sleeve, are electrically isolated which prevents accelerated sodium depletion from the discharge vessel. (For a detailed description of this sodium loss process, reference may be made to the textbook *Electric Discharge Lamps* by Dr. John Waymouth, M.I.T. Press 1971 (Chapter 10)). As compared to a non-shielded lamp in which the elongate support rod typically extends from the lamp stem or is welded to a stem conductor to carry current to the discharge vessel, the fixing of the support rod to the stem with a metal strap is more expensive and intricate. The clips further add to the number of lamp parts and increase lamp cost.

It is also known from U.S. Pat. No. 4,721,876 to surround the glass sleeve by a meshwork of metal wire which is fixed around the sleeve with metal clamping strips. The provision of the meshwork enables a sleeve of smaller wall thickness to be used while still maintaining adequate containment. The clamping strips are also electrically conducting and connected to a current-carrying conductive support rod of the lamp frame which supports the discharge vessel and the glass sleeve. The meshwork as a result is under electrical tension, which causes accelerated sodium depletion from the discharge vessel as discussed above.

The construction of the '876 lamp is complicated. The manufacture of the meshwork, or of a braided assembly, and its manipulation are difficult. With the clamping strips, the sleeve tends to shift when the lamp is jarred during shipping or handling. Furthermore, the securing of the clamping strips about the meshwork and sleeve requires expensive banding equipment and/or hand welding to the lamp frame which increases lamp cost.

It is also known to use outer lamp bulbs which have a larger wall thickness than standard bulbs to protect against failure in the event of a discharge vessel explosion. However, using such non-standard bulbs greatly increases lamp cost.

SUMMARY OF THE INVENTION

It is an object of the invention to provide an electric lamp of the kind mentioned in the opening paragraph which is of a simple and reliable construction and which can be manufactured with lower cost.

According to the invention, this object is achieved in that each of the seals further includes a clamping lead extending therefrom and engaging a respective end of the sleeve to secure the sleeve therebetween.

The clamping leads may be easily provided in the seal during pressing thereof and are less costly than the known straps and clips while providing reliable fixation of the sleeve about the discharge vessel.

According to a favorable embodiment, the discharge vessel and sleeve are supported within the outer lamp envelope solely by the conductive feed-throughs extending from the seals being fixed to respective conductive support rods of the frame means which extend from the lamp stem. This provides a simple, low cost, light weight, readily manufacturable and sturdy lamp construction and avoids the use of extra clips and straps as in the prior art.

According to another aspect of the invention, the containment shield further includes a helically coiled metal wire which surrounds the sleeve and is fixed around this sleeve so as to be electrically isolated. The helically coiled metal wire is significantly easier to handle than the known meshwork while still allowing a significant reduction in the wall thickness of the sleeve for the same level of containment.

The wire may be fastened to one of the current conductors by means of an electrically insulating bridge. An alternative possibility, however, is that the wire is fastened to the sleeve, for example, in that ends of the wire are fastened to the sleeve with cement or are fused into the sleeve.

A very attractive, convenient and reliable fastening is one in which the wire is fixed around the sleeve by its own clamping force. The wire has in that case been coiled on a mandrel with a smaller diameter than the sleeve, and has been twisted, for example against its coiling direction, during assembly so as to give its turn a larger diameter. After the wire has been applied around the sleeve, the twisting force is released and the wire will surround the sleeve with clamping fit.

In yet another embodiment, the clamping leads engage over portions of the helical metal wire. This ensures in a simple manner that the helical wire will not be axially displaced if the clamping force of the wire on the sleeve is reduced over a long lamp life due to many cycles of heating and cooling from normal lamp use.

In yet another embodiment, the metal wire includes bent portions which engage the ends of the sleeve to axially secure it thereon. The bent portions are preferably at the ends of the helically coiled wire, which provides a simple shape and permits easy installation on the sleeve. The wire may also have a clamping fit with the sleeve as described above. The combination of the clamping fit and the bent end portions ensures that the metal wire does not rattle on the sleeve if the lamp is subject to vibration while the bent end portions guarantee that the metal wire will not be axially displaced should its clamping force be reduced over lamp life.

In spite of the comparatively great pitch which the wire may have, for example several mm, for example 4 or 9 mm, the wire provides a good electrical screening of the current conductor which runs alongside the discharge vessel and also on that account counteracts the disappearance of sodium, if this should be present in the discharge vessel. The construction provides a reliable protection against damage to the outer bulb in the case of an exploding discharge vessel. The influence on the luminous flux of the lamp is very slight.

These and other objects, features and advantages of the invention will become apparent with reference to the following drawings, detailed description and claims.

DESCRIPTION OF THE PREFERRED EMBODIMENTS

Figure 1:
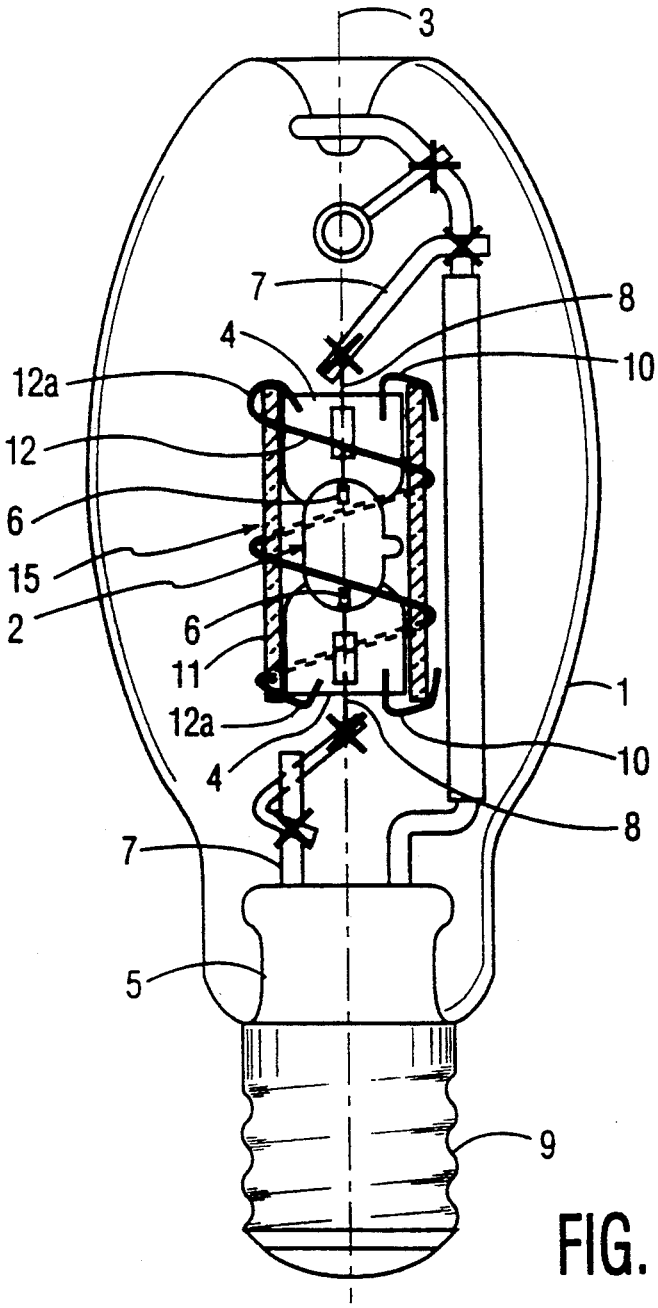
FIG. 1 shows an embodiment of the electric lamp according to the invention in side elevation.

In FIG. 1, the electric discharge lamp has an outer lamp bulb, or envelope, 1 which is closed in a gas-tight manner and which accommodates a discharge vessel 2 which is closed in a gas-tight manner and which has an axis 3 and seals 4 on its axis. A pair of discharge electrodes 6 are present in the discharge vessel along with an ionizable, discharge sustaining medium. Frame means include rigid conductive support rods 7 a,b which extend in a conventional manner from the lamp stem 5 and are connected to the lamp cap 9 outside the outer bulb.

Each of the seals 4 includes a metallic feed-through 8 connected to a respective discharge electrode 6 and an electrically isolated clamping lead 10 which has one end embedded in the seal 4. The feed-throughs 8 which are connected to the discharge electrodes 6 are fixed to respective ones of the conductive support rods *7a,b* by conductive straps *7c,d* to support the discharge vessel within the outer envelope and to electrically connect the discharge electrodes to a source of electric potential outside of the lamp envelope through lamp cap 9.

A light-transmissive containment shield 15 includes a tubular circular cylindrical glass sleeve 11 and a helically coiled metal wire 12. The electrically isolated clamping leads 10 engage a respective end of the sleeve to axially secure it to the discharge vessel. The sleeve 11 is also electrically isolated. The clamping leads are readily provided in the seal during pressing. Preferably, this is accomplished with a "U"-shaped hairpin assembly (shown partly in dashed lines in FIG. 2) in which the free end *8c* of the feed-through not connected to foil portion *8b* is sealed into the seal during pressing. The curved end of the "U" outside of the seal is then cut-off and the end part represented by the dashed line is bent over the end of the sleeve and becomes the clamping lead 10.

The helically coiled metal wire 12 surrounds the glass sleeve 11 and is fixed around the sleeve so as to be electrically floating. To achieve this, for example, resistance wire may be used, for example, of kanthal, tantalum molybdenum, or stainless steel wire. In the lamp shown, molybdenum wire of 0.60 mm diameter is used, coiled with a pitch of 5 mm. The coiled wire is thin and has an open structure. Influence on the luminous flux of the lamp, therefore, is scarcely perceivable. The diameter of the coil is selected such that it has a clamping fit on the tube. Bent end portions *12a* engage over the ends of the sleeve to further axially secure the wire on the sleeve.

Because of the helical wire, the tube may have a reduced wall thickness of, for example, about 1 mm and provide the same level of containment as the sleeve according to the above-mentioned U.S. Pat. No. 5,136,204, in which the commercially available embodiment had a wall thickness of 2 mm. With the coiled wire and the 1 mm sleeve, the containment shield 15 has a weight which is about half that of the prior art 2 mm sleeve. This weight reduction allows the sub-assembly of the discharge vessel and containment shield to be supported by the feed-throughs 8 and straps *7c*, *7d*. In the lamp shown, the feed-throughs 8 are 0.60 mm in molybdenum wire, the lower straps *7d* is 0.025 mm by 0.16 mm nickel, and the upper strap *7c* is a stainless steel wire having a diameter of 0.16 mm.

The above construction is attractive because the discharge vessel 2, sleeve 11, and wire 12 can be provided during lamp assembly as a completed sub-assembly. The subassembly is then easily connected to the frame by welding the ends of the conductive feed-throughs 8 to the conductive support straps *7c,d*, which are part of the conductive support rods.

The lamp shown in FIG. 1 is a high-pressure metal halide discharge lamp which contains metal halides, mercury, and rare gas. The lamp consumes a power of 100 W during operation. The outer envelope was a standard, commercially available BD-17 bulb having a wall thickness which varies from about 0.6 mm to about 1 mm.

During stable lamp operation, the discharge vessel was made to explode by means of a current surge. The standard thickness outer bulb remained entirely undamaged during this, which proves that the construction of the lamp effectively protects the surrounding against the consequences of an explosion of the discharge vessel.

Additionally, the lamp was drop tested to ensure the ruggedness of the fixation between the wire 12, the sleeve 11 and discharge vessel 2 as well as between the above subassembly and the frame at the welds between the conductive feed-throughs 8 and the conductive support rods *7a,b* and straps *7c*, *7d*. In this standard drop test an outer cardboard box containing 12 lamps in their commercial packaging is dropped a total of ten times from a height of thirty inches: six times with each one of the flat sides coming down first, twice with an edge coming down first, and twice with a corner coming down first. The lamps are then checked for breakage, bending of stem rods, etc. None of the lamps according to the invention were found to fail.

The wire 12 surrounding the sleeve and the glass sleeve 11 itself are electrically floating. Disappearance of sodium, if present, from the discharge vessel is effectively counteracted by this. If an electron should be detached from the wire 12 by UV radiation, the wire is given a positive potential which slows down further electron losses.

It was found that the construction is sufficiently effective and reliable when the wire surrounds the pair of electrodes, i.e. the cavity of the discharge vessel laterally.

Figure 2:
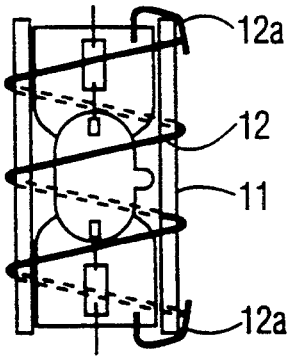
FIG. 2 shows the connection of the metal wire, the sleeve, and discharge vessel according to another embodiment of the invention.

In FIG. 2, the wire is fixed around the sleeve 11 by its own clamping force. The ends of the electrically isolated clamping leads 10 engage over adjacent portions of the wire 12. This ensures that the wire 12 will not shift over lamp life should its clamping force be reduced due to relaxation from the many heating/cooling cycles to which it subject during normal lamp use. Alternatively, even without the ends of the clamping leads 10 engaging over the wire 12, the bent over leads 10 will act as end stops to prevent the wire from shifting significantly.

While there has been shown what is the preferred embodiments of the invention, it will be apparent to those of ordinary skill in the art that various modifications may be made within the scope of the appended claims. For that purpose, the detailed description is to be understood to be illustrative only and not limiting.

What is claimed is:

1. A high pressure discharge lamp having an outer envelope, a discharge vessel arranged within said outer envelope and energizeable for emitting light, said discharge vessel including a pair of discharge electrodes, opposing seals sealing said discharge vessel in a gas-tight manner and a conductive feed-through extending from each discharge electrode through a respective seal to the exterior, frame means for supporting said discharge vessel within said outer envelope and for electrically connecting said discharge vessel to a source of electric potential outside of said lamp envelope, a containment shield comprised of a light-transmissive sleeve disposed about said discharge vessel and having opposing ends each adjacent a respective said seal of said discharge vessel, characterized in that:

each of said seals includes a clamping lead having an end portion embedded in the respective seal, said clamping leads issuing from the respective seal and engaging a respective end of said sleeve to axially secure said sleeve between said clamping leads.

2. A high pressure discharge lamp according to claim 1, wherein Said discharge vessel and sleeve are secured to said frame means solely by said conductive feed-throughs which extend from said seals.

3. A high pressure discharge lamp according to claim 2, wherein said containment shield further includes a helically coiled metal wire coiled about said sleeve, said coiled wire being free of contact with any current-carrying portions of said frame means and being electrically isolated.

4. A high pressure discharge lamp according to claim 3, wherein said coiled length of wire includes bent portions bent over respective opposing ends of said sleeve for preventing axial movement of said coiled wire on said sleeve.

5. A high pressure discharge lamp according to claim 4, wherein said helically coiled metal wire has a clamping fit with said sleeve.

6. A high pressure discharge lamp according to claim 3, wherein said clamping leads clampingly engage over portions of said helically coiled metal wire.

7. A high pressure discharge lamp according to claim 3, wherein said helically coiled metal wire has a clamping fit with said sleeve.

8. A high pressure discharge lamp according to claim 3, wherein said helically coiled metal wire is secured on said sleeve solely by a clamping fit with said sleeve.

9. A high pressure discharge lamp according to claim 1, wherein said containment shield further includes a helically coiled metal wire coiled about said sleeve, said length of wire being free of contact with any current carrying portions of said frame means.

10. A high pressure discharge lamp according to claim 9, wherein said clamping leads clampingly engage over portions of said helically coiled metal wire.

11. A high pressure discharge lamp according to claim 9, wherein said helically coiled metal wire is secured on said sleeve solely by a clamping fit with said sleeve.

12. A metal halide discharge lamp, comprising:

a) an outer envelope sealed in a gas-tight manner;

b) a lamp frame including first and second conductive support rods; and c) a shielded discharge vessel sub-assembly including i) a discharge vessel arranged within said outer envelope, said discharge vessel including a pair of opposing discharge electrodes, conductive feed-throughs extending from said discharge electrodes to the exterior of said discharge vessel, a pair of opposing press seals sealing said discharge vessel in a gas-tight manner, a discharge sustaining fill including mercury, a metal halide, and a rare gas, and a respective clamping lead having an end portion embedded in and issuing from each of said press seals, said clamping leads being electrically isolated from said feedthroughs connected to said discharge electrodes; and ii) a containment shield disposed about said discharge vessel, said containment shield including a light-transmissive sleeve having opposing ends each adjacent a respective said press seal and a length of helically coiled wire coiled about said sleeve, said conductive feed-throughs connected to said discharge electrodes being fixed to respective ones of said conductive support rods for supporting said discharge vessel within said outer envelope and for electrically connecting said discharge vessel to a source of electric potential outside of said lamp envelope, said electrically isolated clamping leads including bent end-portions engaging a respective end of said sleeve to axially secure said sleeve between said clamping leads, and said sleeve and said helically coiled wire being free of contact with said lamp frame and being electrically isolated therefrom.

13. A metal halide discharge lamp according to claim 12, wherein said coiled length of wire includes bent portions bent over respective opposing ends of said sleeve for preventing axial movement of said coiled wire on said sleeve.

14. A metal halide discharge lamp according to claim 13, wherein said helically coiled metal wire has a clamping fit with said sleeve.

15. A metal halide discharge lamp according to claim 12, wherein said helically coiled metal wire has a clamping fit with said sleeve.

16. A metal halide discharge lamp according to claim 12, wherein said clamping leads clampingly engage over portions of said helically coiled metal wire.

17. A metal halide discharge lamp according to claim 12, wherein said outer envelope has a maximum wall thickness of less than about 1 mm, and said containment shield is effective to prevent failure of said outer envelope in the event of explosive rupture of said discharge vessel.

18. A metal halide discharge lamp according to claim 17, wherein said discharge vessel has a rated wattage of about 100 W or less.

* * * * *